US005308085A

United States Patent [19]

Koole

[11] Patent Number: 5,308,085

[45] Date of Patent: May 3, 1994

[54] GAME NET POST

[75] Inventor: Peter M. Koole, Kloetinge, Netherlands

[73] Assignee: Scheide International B.V., Olympiastraat, Netherlands

[21] Appl. No.: 63,909

[22] Filed: May 19, 1993

[51] Int. Cl.[5] ..... A63B 61/02

[52] U.S. Cl. ..... 273/411; 273/29 BB

[58] Field of Search ..... 273/411, 29 BA, 29 BB

[56] References Cited

U.S. PATENT DOCUMENTS

| | | | |
|---|---|---|---|
| 4,706,964 | 11/1987 | Genovese | 273/411 X |
| 4,993,719 | 2/1991 | Hernandez | 273/411 |
| 5,215,310 | 6/1993 | Allbright | 273/411 |

FOREIGN PATENT DOCUMENTS

| | | | |
|---|---|---|---|
| 1068217 | 2/1954 | France | 273/411 |

*Primary Examiner*—William H. Grieb
*Attorney, Agent, or Firm*—Brooks & Kushman

[57] ABSTRACT

A game net post comprising an inner pipe adapted to be placed in substantially vertical position into a sleeve or pot arranged in the ground or floor and an outer pipe, having an internal cross sectional dimension greater than the external cross sectional dimension of said inner pipe, which is slidable over at least part of said inner pipe, said outer pipe being provided with upper and lower means for attaching a game net.

Preferably the outer pipe at its top is provided with an at least diametrical suspension means from which suspends a rod extending substantially along the pipe axis, there being provided around said rod, between stop means arranged on the rod and said rod guiding means, resilient means in permanently tensioned state.

Said resilient means may comprise a helical compression spring, which has been dimensioned such that in the partially compressed state in which the net post is ready for use, its resilient force substantially equals the total weight of said upper pipe and all parts affixed to it except for the game net and tensioning cables thereof.

6 Claims, 4 Drawing Sheets

GAME NET POST

FIELD OF THE INVENTION

The invention relates to a game net post such as a volleybal net post.

STATE OF THE ART

The assignee has manufactured game net posts comprising an inner pipe and an outer pipe. The outer pipe was adapted to be placed in substantially vertical position into a sleeve or pot arranged in the ground or floor and was therefore the lower pipe. The inner pipe had external cross sectional dimensions which were smaller than the internal dimensions of the outer or lower pipe and was slidable in said outer pipe, at least over a top part thereof. The inner pipe could therefore also be called upper pipe. Thru the slidable relationship the net post could be telescoped between a storing condition and an extended condition or condition ready for use in which the game net could be attached to the post.

Game nets usually have upper and lower attachment or tensioning cables. Therefore upper and lower attachment means are required to be affixed to the net post. In the state of the art the upper net attachment means were affixed to the upper pipe and the lower net attachment means were affixed to the lower pipe.

As far as the lower attachment means were hooks, they were slidably arranged in appropriate slits of the post. Otherwise it has been customary to provide several variations in terms of attachment and/or tensioning means for the net, all starting from one basic net post structure. Tensioning means could comprise a ratchet or rotary tensioning means, to be operated by a cranked handle, and by which a threaded spindle could be displaced. For some game fields and embodiment is required which has still simple hooks, but in other cases net tensioning cables will be guided over rollers. Also there is a distinction between end posts and centre posts which are being used for attachment of nets onto adjacent game fields. In all cases, the top pipe had to be lifted, when preparing the post for the game, by manual force.

OBJECTS OF THE INVENTION

The main object of this invention is to provide a two part game net post whereby all attachment means for the game nets can be affixed to one part, to wit the upper or movable part. Another object is to substantially counterbalance the weight of this movable part including the attachment and tensioning means affixed thereto.

SUMMARY OF THE INVENTION

At least the main object is realized by making the pipe adapted to be placed into the ground sleeve or pot the inner pipe, and making the outer pipe the upper pipe so that the latter can be telescoped up and down and can be provided with the means for attaching and/or tensioning a game net in all variations of these means as required in practice.

When the lower or inner pipe is chosen to be of the type conventionally used for game net posts, the basic idea of the invention will result in cross sectional dimensions of the upper or outer pipe which are greater than the external dimensions of the lower or inner pipe.

These greater dimensions allow for a further elaboration wherein the outer pipe at its top is provided with an at least diametrical suspension means from which suspense a rod extending substantially along the pipe axis, the inner pipe at its top is provided with guiding means substantially centrally located in the inner pipe and thru which said rod extends slidably, there being provided around said rod between stop means arranged on the rod and said rod guiding means resilient means in permanently tensioned state.

These resilient means, which preferably comprise a helical compression spring, can be dimensioned such as to realize one of the further objects of the invention, to wit by substantially counterbalancing the weight of the outer pipe with all parts affixed to it. One may choose the spring characteristics such that a very slight overcompensation of the weight will be reached. Thereby the outer pipe will of itself move outwardly from the storage position into the position ready for use, and reversely it will have to be pulled down, with a minor force, into its storage position.

DESCRIPTION OF A PREFERRED EMBODIMENT

Figures 1, 2, 3:
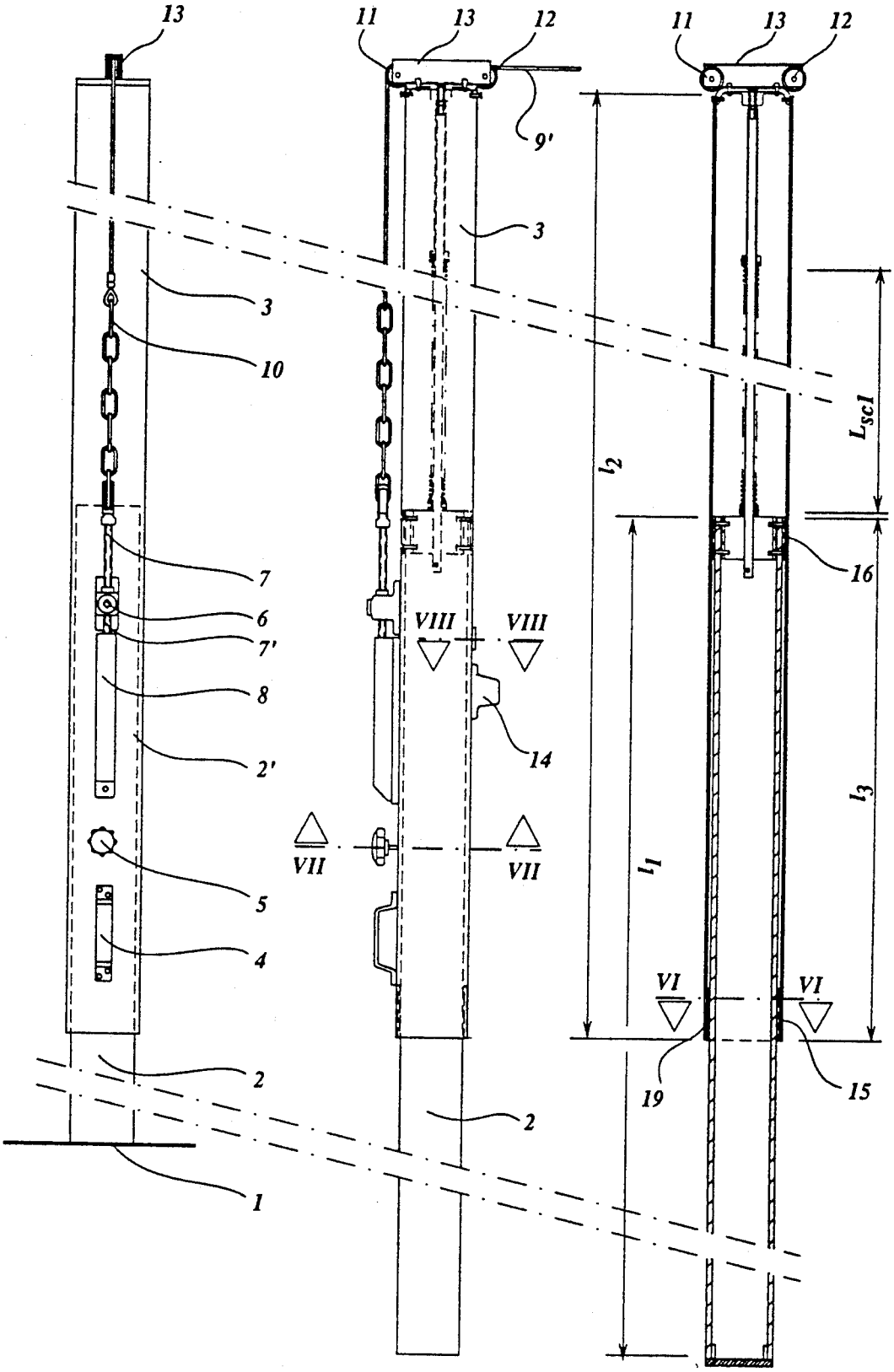
FIG. 1 is a schematic elevational view of a game net post according to this invention for the part which projects above the ground or floor in a position ready for use.
FIG. 2 is a view of the same post depicted completely, under right angles with respect to the view of FIG. 1.
FIG. 3 is a schematic cross sectional view, seen from the same direction as in FIG. 2, but omitting all exterior parts which are attached to the circumferential outer face of the outer pipe.
Figure 5:
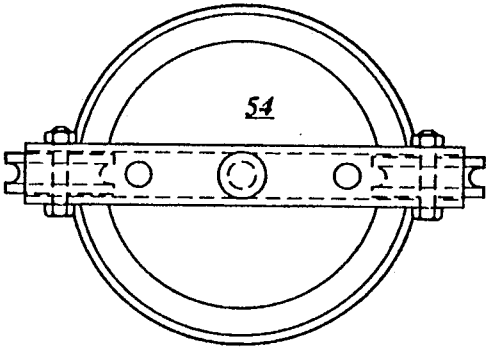
FIG. 5 is the associated top view on the same scale as FIG. 4.

FIG. 1 shows the game net post in its position ready for use for the part which projects above ground or floor level 1. FIG. 2 to the contrary, represents the post in its full length, i.e. before placing it into the ground sleeve or pot. The pipe is, in a manner known in itself, adapted to be placed in the substantially vertical position represented into a sleeve or pot which is embedded or otherwise arranged in the ground or floor; this is entirely as known in this art and it is therefore not represented.

Embedded in this manner in the ground or floor is, more particularly, a lower pipe piece indicated by 2, which in connection with the present invention will also be called inner pipe. This is because, contrary to the prior art, there is a pipe 3 slidable with respect to pipe 2, but having an internal cross sectional dimension greater than the external cross sectional dimension of pipe 2. Therefore slidable, upper pipe 3, will here also be called outer pipe. In FIGS. 1 and 2 the broken line 2' indicates the part of inner pipe 2 which extends inside outer pipe 3. This length will be sufficient to provide for the necessary stability of the overall post during use.

FIGS. 1 and 2 also show, first of all, a handle 4 affixed to upper pipe 3 in order to control the relative vertical position of upper pipe 3 with respect to lower pipe 2; this can be done after untying knob 5 which, in a manner known in itself, can be used for fixation of pipes 2, 3 after adjustment of the proper position.

The main effect of the structure of this invention is: fixation of all attachment means for the game net to the outer pipe 3. Firstly, in this embodiment, there is the tensioning mechanism 6 thru which vertical threaded spindle 7 extends. It is operated by means of a cranked handle, not represented, which can be inserted in mechanism 6 and which is effective to rotate a worm which is an engagement with the part of threaded spindle 7 which finds itself interior to mechanism 6. Part 7' of threaded spindle 7 which extends at any moment below mechanism 6 is protected by a cap 8 also affixed to pipe 3. By operating upon mechanism 6, threaded spindle 7 can be moved up and down in order to bring steel cable 9, which is connected thereto by a piece of chain 10, and which at its other end 9' carries the game net not represented, under the required tension.

On top of pipe 3 there are two cable guide rollers 11 and 12 which are carried by an element 13 which is affixed, in a manner to be described in further detail, on top of pipe 3.

Since all game nets also have a lower rope which is to be attached to some attachment means carried by the net post, this embodiment shows clam cleat 14 which is known in this art for this purpose. According to the invention it is also attached to outer pipe 3.

In the result, tensioning mechanism 6, guide rollers 11 and 12 and clam cleat 14 all go up and down along with up and down adjustment of outer pipe 3.

FIG. 3 shows the location of guiding means which serve to properly, i.e. without lateral play, guide outer tube 3 when it is slid over inner pipe 2. A pair of lower anti-friction strips such as 15 is attached to outer pipe 3 near the bottom end thereof, and a pair of similar anti-friction strips such as 16 is attached to inner pipe 2 near the top end thereof. For further details the reader is referred to FIGS. 4 and 6, respectively.

Figure 4:
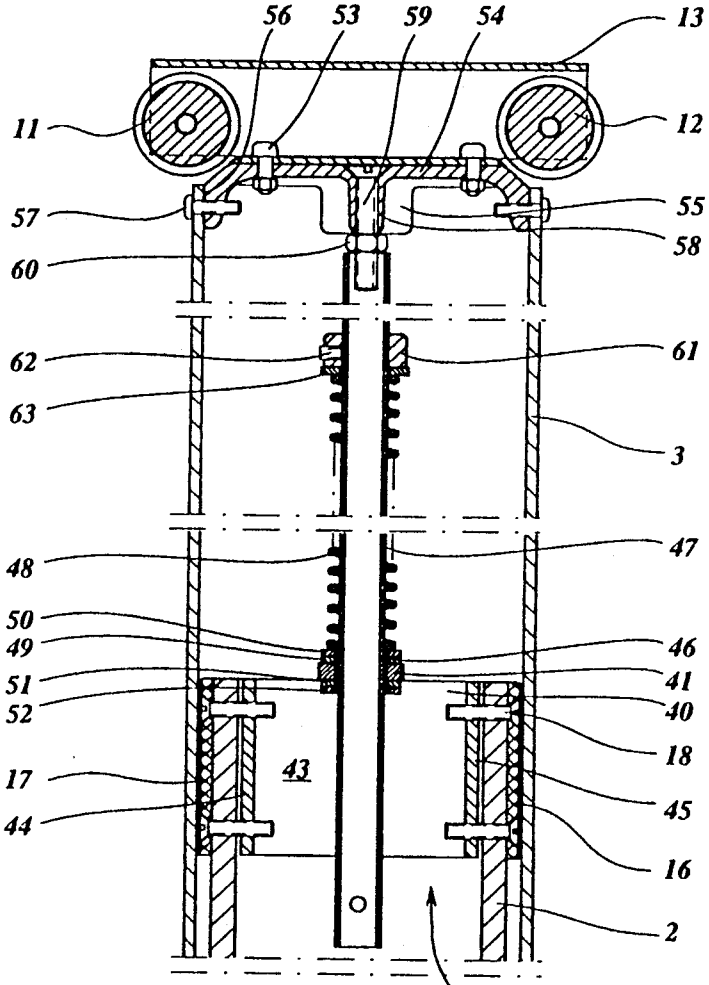
FIG. 4 is the top part of the axial sectional view of FIG. 3 in an enlarged scale and therefore in more detail.
Figure 6:
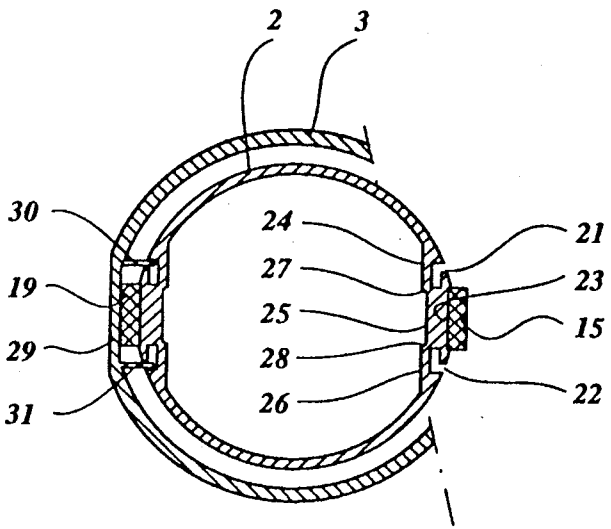
FIG. 6 is a cross sectional view according to the arrows VI—VI of FIG. 3, on the same scale as FIGS. 4 and 5.

FIG. 4 shows the two upper anti-friction strips 16 and 17 affixed by a pair each of flatheaded screws such as 18, the flat heads of which are countersunk into the stripsurface, to inner pipe 2. FIG. 6 shows the cross sectional view of lower strips 15 and 19, the fact that they are situated at opposite places in the cross section, and the manner in which they are situated between inner and outer tubes 2 and 3, respectively.

FIG. 6 also shows the cross sectional profiles of tubes 2 and 3. Pipe 2 is a regular and well known game net post profile. Between a pair of slits 21 and 22 in the outer circumferential pipe surface, which slits are L-shaped in cross section, the outer pipe surface presents a flat region 23. The inside pipe surface behind the slits and flat region comprise three regions flat in themselves, indicated by 24, 25, 26 respectively, with transitions 27 and 28 between them. Anti-friction strip 15 is affixed at the location of flat region 23. At the diametrically opposed place of pipe 2 the structure is entirely similar.

Outer pipe 3 has a cross sectional profile especially designed in connection with the present invention. The greater part is circular, but there is a region 29 which is flat at the exterior and the interior surface. On either side of flat part 29 two flat ribs 30, 31 project inwardly. The spacing of these ribs as well as the length thereof in a direction parallel to the diametrical line halfway inbetween them are such that they fit slidably within one pair of L-shaped slits in the exterior surface of inner pipe 22. It will be clear that a structure similar to the one indicated by 29, 30 and 31 is provided at the opposite place, this part being omitted for the sake of clarity of the drawing. The flat outer surfaces of anti-friction strips such as 15 and 17, which are affixed to inner pipe 2 (compare FIG. 4), will slide with poor friction along the inside of flat portions such as 29 in outer pipe 3. The ribs such as 30, 31 will prevent any co-axial rotation between the two pipes because of the fitting arrangement of these ribs inside the L-shaped slits in inner pipe 2.

Figure 7:
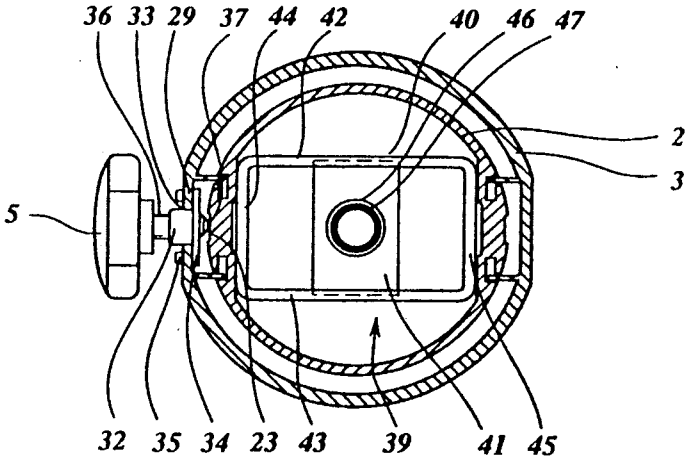
FIG. 7 is a cross sectional view according to the arrows VII—VII of FIG. 2, again on the same scale as FIGS. 4–6.

The flats 23 and 29 are also utilized for a clamping mutual fixation of the two tubes 2, 3, in the manner illustrated in FIG. 7. A nut 32, which may be round, extends thru a borehole 33 in flat portion 29 of outer pipe 3. Integrally formed with nut 32 or permanently affixed thereto such as by welding, is a plate 34 which is lying at the inside of flat portion 29 and is affixed thereto by a pair of screws such as 35 which will prevent rotation of nut 32 in hole 33. Knob 5 is carried by a threaded piece 36, the thread of which matches with the internal thread of nut 32, and which has a pointed end 37. When turning knob 5 inwardly, nylon tipped end 37 may be pressed against the flat region 23 of inner pipe 2, by which any axial movement of 2 relative to 3 will be prevented.

FIG. 7 also shows the bottom view of a head piece 39 for inner pipe 2, which is visible in axial sectional view in FIG. 4. Head piece 39 comprises a substantially rectangular cylindrical upstanding part 40 on top of which a flat piece 41 has been welded, which is substantially symmetrically bridging the longer sides 42 and 43 of head piece 39. Shorter sides 44 and 45 have such a spacing that head piece 49 as a whole fits within the flats such as 24, 26 (FIG. 6) of inner pipe 2 and the corresponding flats at the opposite side. The result of this is that head piece 39 is secured against relative rotation with respect to inner pipe 2. When head piece 39 is arranged within inner pipe 2, at the top thereof as represented in FIG. 4, vertical displacement will be prevented because the crews such as 18 used for fixation of the anti-friction strips 16 and 17 will also penetrate thru appropriate holes in the shorter walls 44, 45 of head piece 39.

Bridge piece 41 is provided with a central bore 46 thru which a rod 47 extends freely. Rod 47 is suspended from a head piece on top of outer pipe 3, which will be described below. Around rod 47 is a helical compression spring 48.

When mounting this part of the net post assembly a steel washer ring 49 is firstly, and a nylon washer ring 50 is secondly included between bridge piece 41 and the lower end of spring 47. Similarly steel and nylon washers 51 and 52, respectively, are included below bridge piece 41. They are prevented from falling off rod 47 by a split pin 53 put thru a diametrically extending bore near the lower end of rod 47.

On top of outer pipe 3 there is a head piece 54. It is reversed saucer-shaped, the circumferential edge 55 depending and fitting within the inner diameter of outer pipe 3. Circumferential edge 55 is provided with two opposite threaded bores, into which two bolts 56, 57 can be engaged in order to affix head piece 54 to the top end of outer tube 3.

On top of head piece 54 a square tube piece is attached by means of bolts and nuts such as 53, and which piece functions as element 13, mentioned earlier, which carries guiding rollers 11 and 12 for cable 9.

Centrally located on saucer-shaped head piece 54, and in the mounted condition also depending therefrom, is a sort of hollow hub 58, thru which a flat headed bolt 59 extends downwardly. The screw thread of bolt 59 matches and is engaged with thread of a nut 60 welded on top of rod 47. By turning bolt 59 into the thread of nut 60, rod 47 will thus be suspended from head piece 54.

At some distance below its top, rod 47 has a stop element 61 affixed thereto by means of adjusting screw 62. When mounting, a nylon washer 63 is again inserted between the top end of spring 48 and stop element 61.

In an actual implementation, lengths $1_1$ of inner tube 2 and $1_2$ of outer tube 3 (see FIG. 3) both are 180 cm. In the condition ready for use, as depicted in FIGS. 1–3, inner tube projects over a distance $1_3$ of 80 cm into outer tube 3. Therefor, in this condition, the distance from the top of inner tube 2, which is the top of head piece 39, to head piece 54 is about 100 cm.

Figure 9:
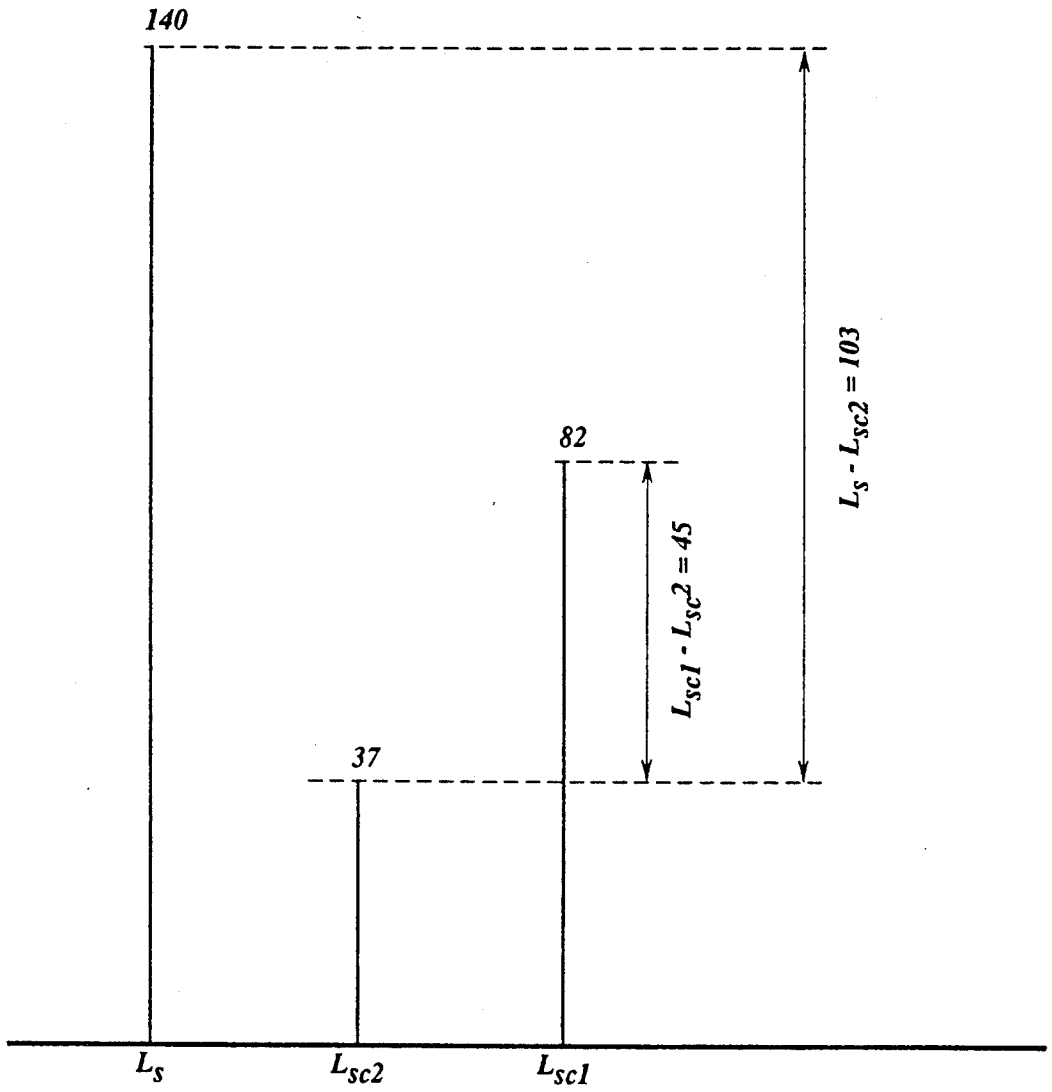
FIG. 9 is a diagram which clarifies the dimensioning of the spring.

In connection with the dimensions of spring 48 reference is made to FIG. 9. Washer 63 below stop element 61 is situated about 18 cm below head piece 54, which results in a length of spring 48 in this condition of about 82 cm; this length will be indicated by $L_{sc1}$. When outer tube 3 is pulled downwardly into the storage position when the game is finished, spring 48 will be compressed between bridge piece 41 and stop element 61 into its so-called block length of no more than 37 cm; this length will be indicated by $L_{sc2}$. This results in an extension between the fully compressed condition of non use and the partly extended condition of use of the net post $L_{sc1}$–$L_{sc2}$ which amounts to 45 cm. This should be compared with the extension length up to the total spring length in the condition of no-compression before mounting, which tension-free length $L_s$ of the spring amounts to about 350 cm. From this it follows that the extension between virtually fully compressed storage state and condition of no compression, $L_{sc}$–$L_{sc2}$ amounts to 103 cm. The value of $L_{sc1}$–$L_{sc2}$ is less of the value of $L_s$–$L_{sc2}$. Spring characteristics decrease linearly as a function of the compression ratio, but because the fraction of the overall spring length which is actually used when the dimensional prescriptions of this invention are followed, is only a fraction no more than 45%, the resilient force of outer pipe 3 with respect to inner pipe 2 is experienced as quite comfortable. The spring characteristics can be so chosen that the resilient force in the condition of use will be made equal to the weight of outer tube plus all attachment elements and other parts which are carried by it, in other words so that there is a virtually perfect counterbalance of the weight of the moving part of the net post. Or one may apply a minor over-compensation of the weight by the spring, so that upper tube 3 will be urged upwardly, while a small force is required to push it down again in its storage position, which forces will increase but even by the time the storage position is reached will not be felt as requiring too great an effort.

Figure 8:
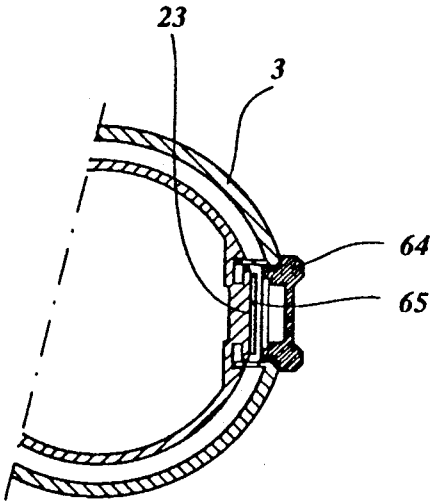
FIG. 8 is a cross-sectional view according to the arrows VIII—VIII of FIG. 2.

FIG. 8 shows an interesting detail which has been made possible by the basic structure of this invention comprising an inner tube and an outer tube. In actual practice the sleeve or pot arranged in the ground or floor will vary somewhat in depth with respect to the ground or floor surface, as a deviation from the manufacturer's specifications. With a standard post length, this may result in slightly varying height of the net. This is, of course, undesirable. FIG. 8 now shows a looking glass 64, which may be a simple molded piece in transparant plastic material, arranged in an appropriate hole in outer tube 3. Inner tube 3, at one of its flats 23, is provided with a height indicator strip 65 at an appropriate level. This indicator strip 65 may be provided with markings in arbitrary units, which will then be visible thru the looking glass 64. For each specific field or ground where the game is played, one may determine once and for all the marking which corresponds with such a mutual position between inner and outer tube that the height of the net above the ground or floor is according to the rules of the game.

What is claimed is:

1. A game net post comprising an inner pipe adapted to be placed in substantially vertical position into a sleeve or pot arranged in the ground or floor, an outer pipe, having an internal cross sectional dimension greater than the external cross sectional dimension of said inner pipe and being slidable over at least part of said inner pipe, said outer pipe being provided with upper and lower means for attaching a game net, and wherein the outer pipe at its top is provided with an at least diametrical suspension means from which suspends a rod extending substantially along the pipe axis, the inner pipe at its top is provided with guiding means substantially centrally located in the inner pipe and thru which said rod extends slidably, there being provided around said rod between stop means arranged on the rod and said rod guiding means resilient means in permanently tensioned state.

2. A game net post as in claim 1, wherein said inner pipe has a cross sectional profile which is conventional for game net posts and in which, at substantially diametrically opposed locations, pairs of L-shaped slits are provided in the outer circumferential pipe face, there being flat regions in the outer surface inbetween said slits of each pair, and wherein the outer pipe has its inside provided with pairs of inwardly protruding ribs at locations substantially corresponding with the locations of said L-shaped slits in said inner pipe such that, in mounted condition, each of said ribs projects at least partially into one of said L-shaped slits so as to allow a sliding relative movement of the inner and outer pipes while preventing relative rotational movement.

3. A game net post as in claim 1, wherein said inner pipe has a cross sectional profile which is conventional for game net posts and in which, at substantially diametrically opposed locations, pairs of L-shaped slits are provided in the outer circumferential pipe face, there being flat regions in the outer surface inbetween said slits of each pair, and wherein the outer pipe has its inside provided with pairs of inwardly protruding ribs at locations substantially corresponding with the locations of said L-shaped slits in said inner pipe such that, in mounted condition, each of said ribs projects at least partially into one of said L-shaped slits so as to allow a sliding relative movement of the inner and outer pipes while preventing relative rotational movement, the outer pipe between the inwardly protruding ribs of each pair, comprising flat parts, there being two guiding strips, each attached to one of said flat regions on the outside of the inner pipe, and being dimensioned such that said flat parts of the outer part will slide along the guide strips during relative axial displacement of the inner and the outer pipes.

4. A game net post as in claim 1, wherein said resilient means comprise a helical compression spring surrounding said rod between said stop means arranged on the rod and said rod guiding means at the top of said inner pipe.

5. A game net post as in claim 1, wherein said resilient means comprise a helical compression spring surrounding said rod between said stop means arranged on the rod and said rod guiding means at the top of said inner pipe, said helical spring being dimensioned such that $$L_{sc1}-L_{sc2} \leqq 0.45\ L_s$$

where $L_s$=full spring length without any compression, $L_{sc1}$ spring length in the partially compressed state in which the net post is ready for use, $L_{sc2}$ spring length compressed in the state of non-use of the net post (which may be the substantially fully compressed state, in which the length is sometimes called block length), and wherein the spring characteristics have further been selected such that the resilient force at length $L_{sc1}$ substantially equals the total weight of said upper pipe and all parts affixed to it except for the game net and tensioning cables thereof.

6. A game net post as in claim 1, wherein said outer pipe is provided with an aperture and a transparant element in said aperture, thru which an indicator strip, provided on said inner tube, is visible.

* * * * *

UNITED STATES PATENT AND TRADEMARK OFFICE

CERTIFICATE OF CORRECTION

PATENT NO. : 5,308,085

DATED : May 3, 1994

INVENTOR(S) : Peter M. Koole

It is certified that error appears in the above-indentified patent and that said Letters Patent is hereby corrected as shown below:

Column 5, line 49, after "compression," delete "$L_{sc}$ -$L_{sc2}$" and insert --$L_s$-$L_{sc2}$--.

Signed and Sealed this

Fifteenth Day of November, 1994

*Attest:*

*Attesting Officer*

BRUCE LEHMAN

*Commissioner of Patents and Trademarks*